US007901214B1

(12) United States Patent
Liebowitz et al.

(10) Patent No.: US 7,901,214 B1
(45) Date of Patent: Mar. 8, 2011

(54) PORTABLE DRAWING SYSTEM

(76) Inventors: Michael J. Liebowitz, Concord, CA (US); Phillip H. Neal, San Rafael, CA (US)

( * ) Notice: Subject to any disclaimer, the term of this patent is extended or adjusted under 35 U.S.C. 154(b) by 506 days.

(21) Appl. No.: 11/970,492

(22) Filed: Jan. 7, 2008

Related U.S. Application Data

(60) Provisional application No. 60/879,263, filed on Jan. 6, 2007.

(51) Int. Cl.
*B43L 1/00* (2006.01)

(52) U.S. Cl. ..... 434/412

(58) Field of Classification Search ..... 434/408, 434/411, 412, 413, 421, 425, 426; 40/515–520; 359/461
See application file for complete search history.

(56) References Cited

U.S. PATENT DOCUMENTS 1,688,677 A * 10/1928 Winter ..... 40/517
2,346,908 A * 4/1944 Corley ..... 206/410
3,255,808 A * 6/1966 Schimizzi ..... 160/245
3,466,776 A * 9/1969 Paige ..... 40/517
4,525,946 A * 7/1985 Olson ..... 40/514
D317,630 S * 6/1991 Allen et al. ..... D20/42
5,207,581 A * 5/1993 Boyd ..... 434/412
2003/0080231 A1* 5/2003 Lowder ..... 242/385.1
2003/0136528 A1* 7/2003 Dunn et al. ..... 160/370.22
2005/0235215 A1* 10/2005 Dunn et al. ..... 715/740
2005/0243416 A1* 11/2005 Choi ..... 359/460
2009/0233265 A1* 9/2009 Budryk et al. ..... 434/412
2010/0055661 A1* 3/2010 Hegwood ..... 434/420

* cited by examiner

*Primary Examiner* — Kurt Fernstrom
(74) *Attorney, Agent, or Firm* — Michael E. Woods

(57) ABSTRACT

A drawing system including a portable storage housing; a drawing surface, moveably coupled to the portable storage housing by a biasing subsystem, the drawing surface including a storage mode and a deployed mode wherein the storage mode provides the drawing surface inside the housing and inaccessible for receipt of content and wherein the deployed mode extends the drawing surface outside of the housing and accessible for receipt of content; wherein transition of the drawing surface from the storage mode to the deployed mode activates the biasing subsystem and wherein the biasing subsystem automatically transitions the drawing surface from the deployed mode to the storage mode when operated by a user.

14 Claims, 4 Drawing Sheets

PORTABLE DRAWING SYSTEM

CROSS REFERENCE TO RELATED APPLICATIONS

This Application claims the benefit of U.S. Provisional Application 60/879,263 filed on Jan. 6, 2007, the disclosure of which is hereby expressly incorporated by reference in its entirety for all purposes.

BACKGROUND OF THE INVENTION

The present invention relates generally to a portable drawing system and method, and more specifically to a system and method providing a storage housing including a deployable/retractable drawing surface and, in some specific embodiments, an auto-erase function as well.

Drawing, drawing tools, and drawing aids are well-known. Many of the tools have versions or modifications to enable portability. For many users, the degree of convenience and desirability of a drawing tool or aid is related to its features and portability.

Also well-known are drawing tools and drawing aids intended for use by children and young adults. A common theme for a certain class of these tools and aids are reusability, particularly of the actual drawing surface. However, this feature is not confined to children's aids and tools as many education and business users desirably employ this feature as well. Examples of these products include chalkboards and dry-erase whiteboards, and the like. These products include a surface and a writing tool that, together, permit repeated application and removal of content.

U.S. Pat. No. 6,164,976 (Creativity Center Apparatus and Method For Use) issued 26 Dec. 2000 to Wilson describes a portable drawing system. The invention described in the '976 patent could be improved. These improvements relate to portability (the drawing surface is sized to match the housing so any increase in drawing surface size decreases portability and convenience. Additionally, the system describes a manual erase mode that is a separate dedicated function.

What is needed is a portable drawing system and method overcoming the disadvantages of existing systems to provide drawing surfaces not limited to a housing size and to provide for an auto-erase mode, that may be disabled for a save mode.

BRIEF SUMMARY OF THE INVENTION

Disclosed is a portable drawing system and method overcoming the disadvantages of existing systems to provide drawing surfaces not limited to a housing size and to provide for an auto-erase mode, that may be disabled for a save mode. The drawing system may include a portable storage housing; a drawing surface, moveably coupled to the portable storage housing by a biasing subsystem, the drawing surface including a storage mode and a deployed mode wherein the storage mode provides the drawing surface inside the housing and inaccessible for receipt of content and wherein the deployed mode extends the drawing surface outside of the housing and accessible for receipt of content; wherein transition of the drawing surface from the storage mode to the deployed mode activates the biasing subsystem and wherein the biasing subsystem automatically transitions the drawing surface from the deployed mode to the storage mode when operated by a user.

An alternative drawing system may include a portable storage housing; and a drawing surface, moveably coupled to the portable storage housing, the drawing surface including a storage mode and a deployed mode wherein the storage mode provides the drawing surface inside the housing and inaccessible for receipt of content and wherein the deployed mode extends the drawing surface outside of the housing and accessible for receipt of content; and wherein the drawing surface includes a flexible surface disposed on a roller contained within the housing.

A benefit of the portable drawing system includes provision of a portable drawing surface that automatically erases the drawn image when retracted and redeployed out of the storage housing. The writing surface utilizes a flexible "dry erase" style component. An advantage of this system is to provide a portable drawing surface and an automatic erase feature on retraction and/or deployment.

DETAILED DESCRIPTION OF THE INVENTION

The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

A preferred embodiment of the present invention is a portable drawing system, and more preferably for a portable drawing system for children and young adults.

Figure 1:
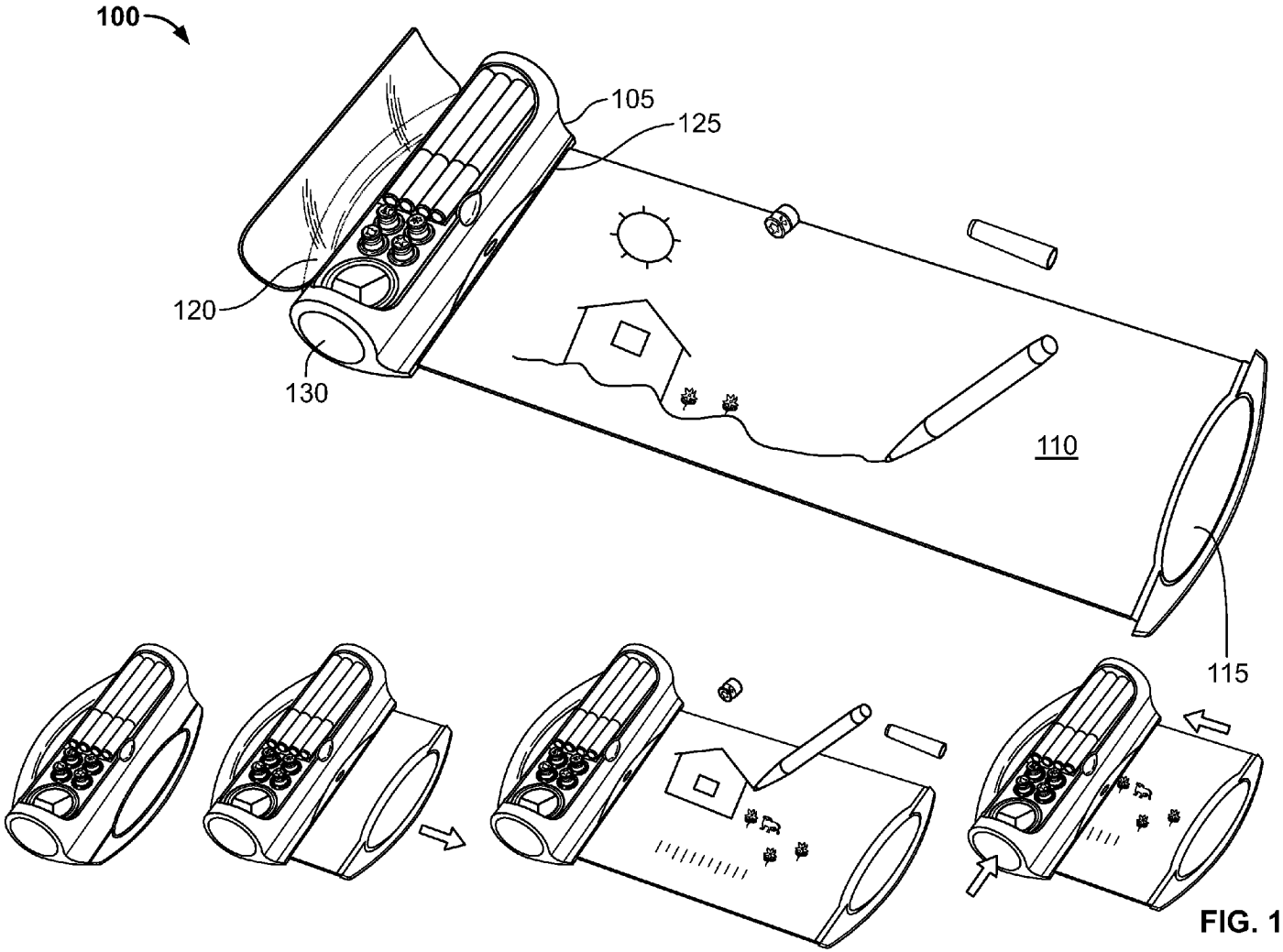
FIG. 1 is a perspective view of a preferred embodiment for a portable drawing system.

FIG. 1 is a perspective view of a preferred embodiment for a portable drawing system 100. System 100 includes a storage housing 105, a flexible drawing surface 110, and handle 115 for transitioning surface 110 from a storage mode to a deployed mode (shown in deployed mode). System 100 optionally includes a biasing subsystem that activates when surface 110 is transitioned to the deployed mode. A user may engage an auto-retract mode and cause the biasing subsystem to automatically transition surface 110 completely into the housing (the storage mode). System 100 also optionally includes an auto-erase function in which a wiper is contacted with surface 110. Preferably this wiper erases during both transitions (deployed-to-storage and storage-to-deployed) and also, as further shown below, includes a selective erase function in which the auto-erase feature may be deactivated (e.g., move the wiper away from surface 110) so that content applied to surface 110 may be saved. The content is protected while stored within housing 105 in contrast to certain prior art solutions. Portable drawing system 100, as shown, is adapted for young children four years and up. System 100 further includes a travel handle 120, an auto eraser 125 built-in to housing 105, and an auto-retract button 130 to trigger the auto retract function. Surface 110 is preferably a flexible dry erase surface. Housing 105 stores dry-erase markers having brilliant colors compatible with surface 110. Further, housing 105 stores dry-erase stamps, both the markers and stamps are non-toxic, child-safe. Advantageously, system 100 is provides for compact travel and storage. In operation, the user draws surface 110 out from housing 105 using handle 115. The user may then use the markers and stamps to create a desired image on surface 110. Thereafter, surface 110 is retracted back into housing 105 and, depending upon the erase mode of the auto eraser, the retraction into housing 105 may erase the image or safely store it inside housing 105.

Figure 2:
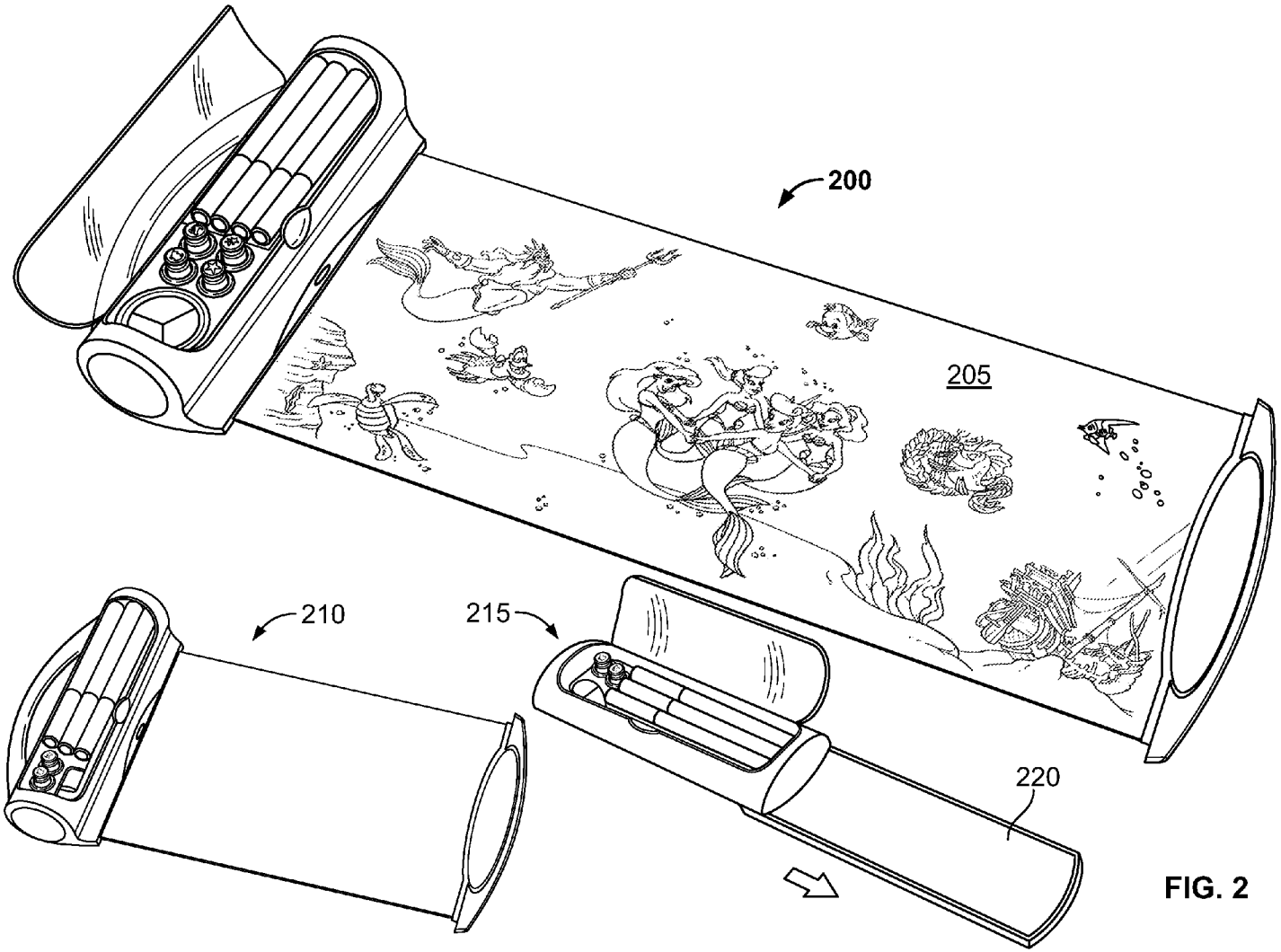
FIG. 2 is a perspective view of alternate preferred embodiments for a portable drawing system.

FIG. 2 is a perspective view of alternate preferred embodiments for a portable drawing system, including a pre-content system 200 having a drawing surface 205 provided with certain content (public domain or proprietary), a min-system 210, and a traveler system 215.

Pre-content system 200 may include licensed recognizable content for "colorization" or game boards, or other activities that may be supplemented with drawing implements suitable for erasable content application to surface 110.

Mini system 210 is a scaled version of system 100 shown in FIG. 1.

Traveler system 215 includes a rigid, auto retracting drawing surface 220 biased to the closed position, and optionally includes the auto-erase/erase-save mode selection options. The systems shown in FIG. 2 may also be described as creative activity platforms.

Figure 3:
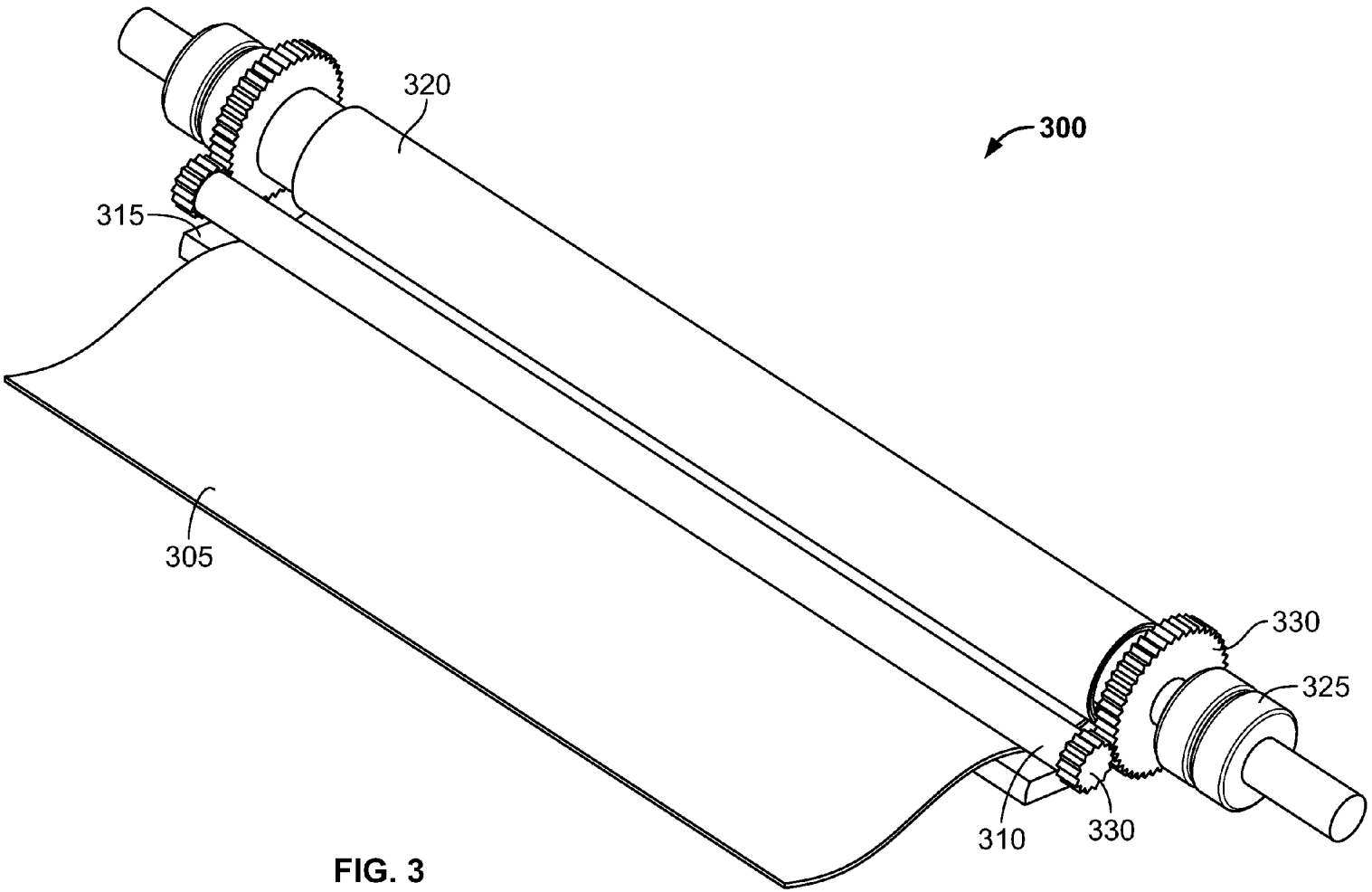
FIG. 3 is a detailed perspective view of an auto-erase mechanism for use in an embodiment of the present invention.

FIG. 3 is a detailed perspective view of an auto-erase mechanism 300 for use in an embodiment of the present invention. Mechanism 300 includes Mylar sheet 305 (e.g., the drawing surface which is flexible in this view) disposed between a wiper roller 310 and a wiper support 315. The Mylar sheet 305 is rolled upon a Mylar roller 320 that is spring loaded to provide part of the biasing subsystem. A ratchet 325 and gears 330 provide a clutching/lock mechanism to permit the Mylar sheet 305 to be locked into the "open" position and to be auto-retracted. Auto-retraction with wiper engaging the Mylar surface that has received erasable content provides an embodiment of the auto-erase function.

Figure 4:
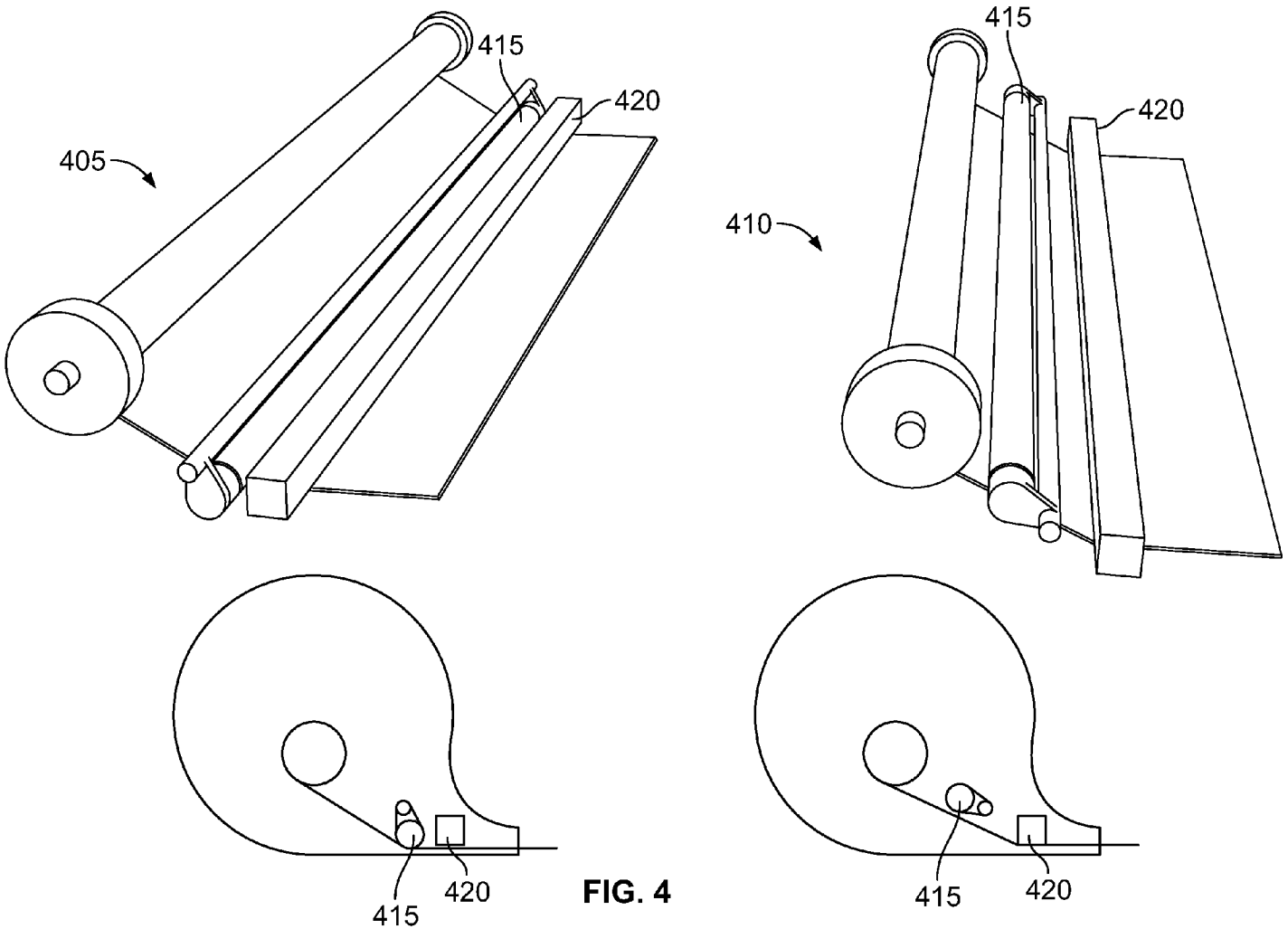
FIG. 4 is a detailed perspective view of a selective auto-erase mechanism for use in an embodiment of the present invention.

FIG. 4 is a detailed perspective view of a selective auto-erase mechanism for use in an embodiment of the present invention. The selective auto-erase enables two operational modes: a save mode (405) and an erase mode (410). These modes provide for different orientations of a nylon roller 415 and an eraser strip 420. In the save mode, nylon roller 415 moves drawing surface away from eraser strip 420. In erase mode, nylon roller 415 no loner supports the drawing surface away from eraser strip 420 and the drawing surface moves across eraser strip 420, erasing any drawing on the drawing surface. Providing for the eraser strip at about 2 degrees angle allows drawing surface to aggressively engage two edges of eraser strip 420.

Preferred embodiments of the invention include a flexible drawing surface combined with a storage housing that features an eraser component that functions when the writing surface is retracted and/or deployed from the storage housing.

A primary benefit of the portable drawing system is to provide a portable drawing surface that automatically erases the drawn image when retracted and redeployed out of the storage housing. The writing surface utilizes a flexible "dry erase" style component.

An advantage of this system is to provide a portable drawing surface and an automatic erase feature on retraction and/or deployment.

This format has multiple applications in children's arts and crafts systems and games (e.g. tic tac toe, hangman and the like), small and large format versions, preprinted drawing surfaces, stencil kits as well as drawing surfaces for coaches and teachers, and the like.

The handle used for deployment may be weighted to provide a means to keep the drawing surface flat (not curled) when in the open position. This handle will also provide a means to grab the drawing surface for deployment.

Another embodiment provides storage means for markers, stamps, stencils and other craft and drawing supplies.

Deployment may be achieved 1) automatically by means of a return spring under tension that "pulls" the drawing tablet back into the storage housing and a ratchet system that is released when a button or lever is pushed or 2) manually by way of a crank for retraction and a handle for deployment.

Eraser component may be achieved by a static/fixed position eraser located on top of the writing surface and an opposing surface providing sufficient friction from beneath the writing surface to effective swipe and wipe clean the marker from the surface both entering and exiting the housing.

Alternately, the eraser component may be achieved by having a dynamic rolling erasure component located on top of the writing surface that is also held with sufficient friction from beneath but also rolls at a different ratio than the travel of the writing surface as it deploys and retracts to provide maximum erasure surface contact both entering and exiting the storage housing.

Another embodiment of the erasure may be a "no erase" option, where the eraser bar is lifted slightly or turned to a non-erasure surface in order to retain the drawn image on retraction and deployment.

Whatever the ultimate erasure component, it is contemplated that this component may be a fixed and "clean-able" component or, alternately may be removable, replaceable and cleanable.

Alternative Embodiments

The general configuration of the portable drawing system also known as "RollAway Worlds" shown in the appendix illustrations and the specific features disclosed are not intended to be limiting. Numerous alternate preferred embodiments for the portable drawing system are within the scope of the present invention.

Another embodiment provides a writing surface that may be a flexible chalkboard style surface component for use with chalk writing instruments and a chalk erasure component.

Another embodiment provides a writing surface that may be a combination of a transparent Mylar combined with a wax-based black pressboard. In this embodiment, the Mylar is separated from the pressboard when retracted and deployed from the storage housing effectively erasing the drawing (created by using pressure to the Mylar against the wax board surface.

Another embodiment provides a hard (not flexible) writing surface deployed and retracted straight out of the narrow end of the storage housing, either manually or via a spring or pivot mechanism). This form also benefits from the erasure when retracted and/or redeployed from the storage housing. This is distinct from a format that manually or automatically wipes the erasure component over the surface (the portable drawing system approach wipes the board clean by moving it dynamically under the erasure component).

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. An apparatus, comprising:

a portable storage housing;

a drawing surface, moveably coupled to said portable storage housing by a biasing subsystem, said drawing surface including a storage mode and a deployed mode wherein said storage mode provides said drawing surface inside said housing and inaccessible for receipt of content and wherein said deployed mode extends said drawing surface outside of said housing and accessible for receipt of content;

wherein transition of said drawing surface from said storage mode to said deployed mode activates said biasing subsystem and wherein said biasing subsystem automatically transitions said drawing surface from said deployed mode to said storage mode when operated by a user wherein said storage housing includes a wiper subsystem integrated into said housing and disposed proximate said drawing surface, said wiper subsystem automatically erasing any content received by said drawing surface during a transition from one of said modes to another of said modes when said wiper subsystem is in an active erase mode.

2. The apparatus of claim 1 wherein said wiper subsystem includes an erase mode and a save mode, with said erase mode including said active erase mode for said wiper subsystem and automatically erasing any content received by said drawing surface during a transition from one of said drawing surface modes to another of said drawing surface modes and with said save mode including an inactive erase mode for said wiper subsystem, said save mode inhibiting said automatic erasing of any content received by said drawing surface and said save mode preserving any content received by said drawing surface during a transition from one of said drawing surface modes to another of said drawing surface modes.

3. The apparatus of claim 1 wherein said drawing surface includes a flexible surface disposed on a roller contained within said housing.

4. An apparatus, comprising:

a portable storage housing; and a drawing surface, moveably coupled to said portable storage housing, said drawing surface including a storage mode and a deployed mode wherein said storage mode provides said drawing surface inside said housing and inaccessible for receipt of content and wherein said deployed mode extends said drawing surface outside of said housing and accessible for receipt of content;

wherein said drawing surface includes a flexible surface disposed on a roller contained within said housing;

wherein said storage housing includes a wiper subsystem integrated into said housing and disposed proximate said drawing surface, said wiper subsystem automatically erasing any content received by said drawing surface during a transition from one of said modes to another of said modes when said wiper subsystem is in an active erase mode.

5. The apparatus of claim 4 wherein said wiper subsystem includes an erase mode and a save mode, with said erase mode including said active erase mode and automatically erasing any content received by said drawing surface during a transition from one of said drawing surface modes to another of said drawing surface modes and with said save mode including an inactive erase mode for said wiper subsystem and inhibiting said automatic erasing of any content received by said drawing surface and said save mode preserving any content received by said drawing surface during a transition from one of said drawing surface modes to another of said drawing surface modes.

6. The apparatus of claim 1 wherein said drawing surface includes a rigid planar element that transitions between said modes without unrolling from an element disposed within said housing.

7. The apparatus of claim 1 wherein drawing surface includes a width that extends a variable length outside said housing when transitioned to said deployed mode.

8. The apparatus of claim 7 wherein said wiper subsystem includes an eraser element having a length about equal to said width of said drawing surface, said eraser element contacting said drawing surface entirely across said width of said drawing surface when said wiper subsystem is in said active erase.

9. The apparatus of claim 4 wherein said drawing surface includes a rigid planar element that transitions between said modes without unrolling from an element disposed within said housing.

10. The apparatus of claim 4 wherein drawing surface includes a width that extends a variable length outside said housing when transitioned to said deployed mode.

11. The apparatus of claim 10 wherein said wiper subsystem includes an eraser element having a length about equal to said width of said drawing surface, said eraser element contacting said drawing surface entirely across said width of said drawing surface when said wiper subsystem is in said active erase mode.

12. A method of operating a drawing system, the method comprising the steps of:

a) transitioning a drawing surface from a storage mode to a deployed mode, said storage mode including said drawing surface disposed within a housing and inaccessible for receipt of content and said deployed mode including said drawing surface extended from said housing and accessible for receipt of content with said housing including an integrated wiper subsystem and said wiper subsystem including an active erase mode in which any received content is removed from said drawing surface during transitions of said drawing surface modes;

b) receiving an erasable element on said drawing surface while said drawing surface is in said deployed mode; and c) transitioning said drawing surface from said deployed mode to said storage mode while said wiper subsystem is in said active erase mode to automatically erase said erasable element as said drawing surface transitions to said storage mode.

13. The method of claim 12 further comprising the step of:

d) switching said wiper subsystem from said active erase mode to an inactive erase mode wherein said wiper subsystem is inhibited from removing received content during transitions of said drawing surface.

14. The method of claim 13 further comprising the step of:

e) switching, after step d) and after said drawing system has fully transitioned to said storage mode with said erasable element received on said drawing surface, said wiper substem to said active erase mode while said drawing surface is in said storage mode; and thereafter f) transitioning said drawing surface from said storage mode to said deployed mode while said wiper system is in said active erase mode to automatically remove said erasable element from said drawing surface as said drawing surface is transitioned from said storage mode to said deployed mode.

* * * * *